US008626404B2

(12) United States Patent
Thomson et al.

(10) Patent No.: US 8,626,404 B2
(45) Date of Patent: Jan. 7, 2014

(54) MOTOR GRADER WHEEL SLIP CONTROL FOR CUT TO GRADE

(75) Inventors: Norval P. Thomson, Dunlap, IL (US); Gregory Durst, Washington, IL (US); Martin Lehman, Congerville, IL (US); Shane McBride, Peoria, IL (US); Daniel P. Sergison, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 465 days.

(21) Appl. No.: 12/950,807

(22) Filed: Nov. 19, 2010

(65) Prior Publication Data

US 2012/0130600 A1 May 24, 2012

(51) Int. Cl.
*B60K 28/00* (2006.01)

(52) U.S. Cl.
USPC ..... 701/50; 701/36; 701/31; 701/53; 701/54; 701/58; 701/69; 701/82; 701/84; 701/89; 701/90; 180/197

(58) Field of Classification Search
None
See application file for complete search history.

(56) References Cited

U.S. PATENT DOCUMENTS

| | | | | | |
|---|---|---|---|---|---|
| 4,444,286 | A | * | 4/1984 | Hawkins et al. | 180/197 |
| 4,521,856 | A | | 6/1985 | Phelps et al. | |
| 4,635,743 | A | * | 1/1987 | Riehl | 180/243 |
| 4,779,202 | A | | 10/1988 | Leiber | |
| 4,807,131 | A | | 2/1989 | Clegg | |
| 5,278,761 | A | | 1/1994 | Ander et al. | |
| 5,315,519 | A | | 5/1994 | Chin et al. | |
| 5,348,115 | A | * | 9/1994 | Devier et al. | 180/308 |
| 5,361,208 | A | * | 11/1994 | Olson et al. | 701/36 |
| 5,363,936 | A | * | 11/1994 | Grawey et al. | 180/9.21 |
| 5,368,120 | A | | 11/1994 | Sakai et al. | |
| 5,375,663 | A | | 12/1994 | Teach | |
| 5,376,868 | A | | 12/1994 | Toyoda et al. | |
| 5,388,658 | A | | 2/1995 | Ando et al. | |
| 5,407,023 | A | | 4/1995 | Yamashita et al. | |
| 5,453,930 | A | | 9/1995 | Imaseki et al. | |
| 5,474,147 | A | * | 12/1995 | Yesel et al. | 180/197 |
| 5,512,905 | A | | 4/1996 | Nichols et al. | |
| 5,553,517 | A | * | 9/1996 | Yesel et al. | 74/731.1 |
| 5,574,643 | A | * | 11/1996 | Yesel | 701/88 |
| 5,629,850 | A | | 5/1997 | Okawa | |
| 5,631,658 | A | | 5/1997 | Gudat et al. | |
| 5,647,439 | A | * | 7/1997 | Burdick et al. | 172/4.5 |
| 5,749,062 | A | | 5/1998 | Yamamoto | |
| 5,775,453 | A | * | 7/1998 | Williams et al. | 180/197 |
| 6,125,561 | A | * | 10/2000 | Shull | 37/415 |
| 6,164,402 | A | * | 12/2000 | Hastreiter | 180/243 |
| 6,191,732 | B1 | | 2/2001 | Carlson et al. | |
| 6,336,068 | B1 | * | 1/2002 | Lawson et al. | 701/50 |
| 6,367,572 | B1 | * | 4/2002 | Maletschek et al. | 180/305 |

(Continued)

FOREIGN PATENT DOCUMENTS

| | | | |
|---|---|---|---|
| GB | 2 316 109 | A | 2/1998 |

*Primary Examiner* — Jonathan M Dager
(74) *Attorney, Agent, or Firm* — Leydig, Voit & Mayer

(57) ABSTRACT

The described system and method are implemented within a motor grader or other machine for grading of surfaces, wherein the machine includes a ground engaging element, as well as one or more blades for removing surface material. In this context, the described system and method prevent slippage of the ground engaging element against the underlying surface. In an embodiment, a torque limit is applied, wherein the torque limit corresponds to a torque that is less than that required for slippage under the current operating conditions, thus avoiding the problems caused by both overly aggressive and overly conservative cut depth strategies.

19 Claims, 6 Drawing Sheets

(56) References Cited

U.S. PATENT DOCUMENTS

| | | | | |
|---|---|---|---|---|
| 6,508,328 | B1 * | 1/2003 | Kenyon et al. | 180/308 |
| 6,644,429 | B2 * | 11/2003 | Evans et al. | 180/307 |
| 6,691,013 | B1 | 2/2004 | Brown | |
| 6,808,036 | B2 | 10/2004 | Pellenc | |
| 6,854,523 | B2 * | 2/2005 | Takahashi | 172/3 |
| 7,325,636 | B2 * | 2/2008 | Yeoman et al. | 180/62 |
| 7,712,559 | B2 * | 5/2010 | Yeoman et al. | 180/62 |
| 7,823,897 | B2 * | 11/2010 | Kelly et al. | 280/233 |
| 7,856,303 | B2 * | 12/2010 | Thompson et al. | 701/50 |
| 2002/0027025 | A1 * | 3/2002 | Kobayashi et al. | 180/6.2 |
| 2002/0100630 | A1 * | 8/2002 | Evans et al. | 180/307 |
| 2002/0129985 | A1 | 9/2002 | Nissen | |
| 2005/0015192 | A1 | 1/2005 | Kato et al. | |
| 2005/0187670 | A1 | 8/2005 | Katayama et al. | |
| 2006/0065465 | A1 * | 3/2006 | Lunzman et al. | 180/242 |
| 2006/0069484 | A1 * | 3/2006 | Thomson et al. | 701/50 |
| 2007/0112498 | A1 | 5/2007 | Yasutake et al. | |
| 2007/0144797 | A1 | 6/2007 | Tarasinski et al. | |
| 2007/0208483 | A1 | 9/2007 | Rabin | |
| 2008/0127530 | A1 * | 6/2008 | Kelly | 37/403 |
| 2008/0243345 | A1 * | 10/2008 | Knight | 701/50 |
| 2008/0275596 | A1 * | 11/2008 | Tarasinski et al. | 701/1 |
| 2009/0204292 | A1 * | 8/2009 | Tate et al. | 701/41 |
| 2010/0114430 | A1 * | 5/2010 | Thomson et al. | 701/41 |
| 2010/0161190 | A1 * | 6/2010 | McCann et al. | 701/69 |

* cited by examiner

MOTOR GRADER WHEEL SLIP CONTROL FOR CUT TO GRADE

TECHNICAL FIELD

This patent disclosure relates generally to control of grading operations and, more particularly to a method and system for controlling wheel slip during a grade to level operation.

BACKGROUND

Motor graders are often used for construction, road-building, rural road resurfacing, shallow ditching, field preparation, and other industrial activities requiring the preparation of a flat earthen or particulate surface. A motor grader typically includes a ground engaging element such as a plurality of wheels that convey the machine over the ground, and a large blade extending from the underside of the machine and disposed generally transverse to both the underlying surface and the direction of travel. The blade can generally be manipulated in a plurality of directions and dimensions by the machine operator.

As the machine traverses over the ground, the blade removes and displaces surface material that comes into contacting engagement with the blade. The vertical amount of material removed in a pass is referred to as the cut depth. Typically, the cut depth is operator controlled depending upon a subjective analysis of the operating conditions as well as the final desired grade level. It will be appreciated that, for larger cut depths, the impedance to the blade, and hence to the movement of the machine itself, can become rather large. In extreme cases, the machine wheels may begin to slip, causing the motor grader to mar or otherwise cause unevenness in the surface being treated. This can result is a substantial loss of productivity as the surface must now be repaired in many cases. Alternatively, to avoid the likelihood of wheel slip, the operator may take multiple passes of overly shallow cut depths. This also results in a substantial loss of productivity.

Current electronic blade control systems such as GPS-guided grading systems provide very precise elevation determination by precisely tracking the location of the blade edge. However, such systems do not prevent the machine from spinning out, i.e., spinning one or more wheels against the underlying surface, if the operator attempts too deep of a cut in a single pass. Although an operator may prevent spinouts by taking many light passes, removing only a small amount of material each time, this technique is also damaging to productivity. In particular, this technique requires substantially more time and fuel than would be needed if the machine were operated closer to its traction limit.

It will be appreciated that this background description has been created by the inventors to aid the reader, and represents concepts known to the inventors. It is not a discussion of, nor reference to, prior art, nor is this section intended to imply that any of the indicated problems were themselves appreciated in the art. While the principles described herein can, in some regards and embodiments, avoid the problems described, it will be appreciated that the scope of the protected innovation is defined by the attached claims, and not by the ability of the claimed invention to solve any specific problem noted herein.

SUMMARY

The described system and method are implemented with a motor grader or other machine for grading of surfaces. The machine includes a ground engaging element, as well as one or more blades for removing surface material. In this context, the described system and method prevent slippage of the ground engaging element against the underlying surface. A torque limit is applied to the ground engaging element based upon available traction. The torque limit corresponds to a torque that is less than that required for slippage, thus avoiding the problems caused by both overly aggressive and overly conservative cut depth strategies.

In one embodiment, the torque limit is a settable limit that is determined by a user based upon an observation of current operating conditions of the ground engaging element. In another embodiment, the torque limit is determined by detection of available traction through any, or a combination of, a traction control system, wheel speed sensors, radar, or other suitable mechanism.

DETAILED DESCRIPTION

In general, this disclosure relates to motor grader machines used for grading of surfaces, i.e., smoothing an earthen or other particulate surface for construction, road building, and other application that requires the creation of a relatively smooth or flat surface. As noted above, a motor grader typically includes a plurality of wheels that convey the machine over the ground, as well as one or more large blades beneath the machine for removing surface material. In this context, the described system prevents a loss of productivity due to spinouts. In particular, the system allows the operator to set the wheel torque limit below a slip point that may be determined based upon current conditions, thus preventing any wheel spin that would cause the finished surface to be repaired. In one realization of the described system, a CVT (continuously variable transmission) of the motor grader is used to limit the torque delivered to the wheels.

With the wheel torque set at a level that provides a maximum level of torque while still avoiding wheel slip, the system minimizes the number of passes that an operator executes to reach the desired grade. The system thus assists the operator by avoiding the problems caused by overly aggressive and overly conservative cut depth strategies.

Figure 1:
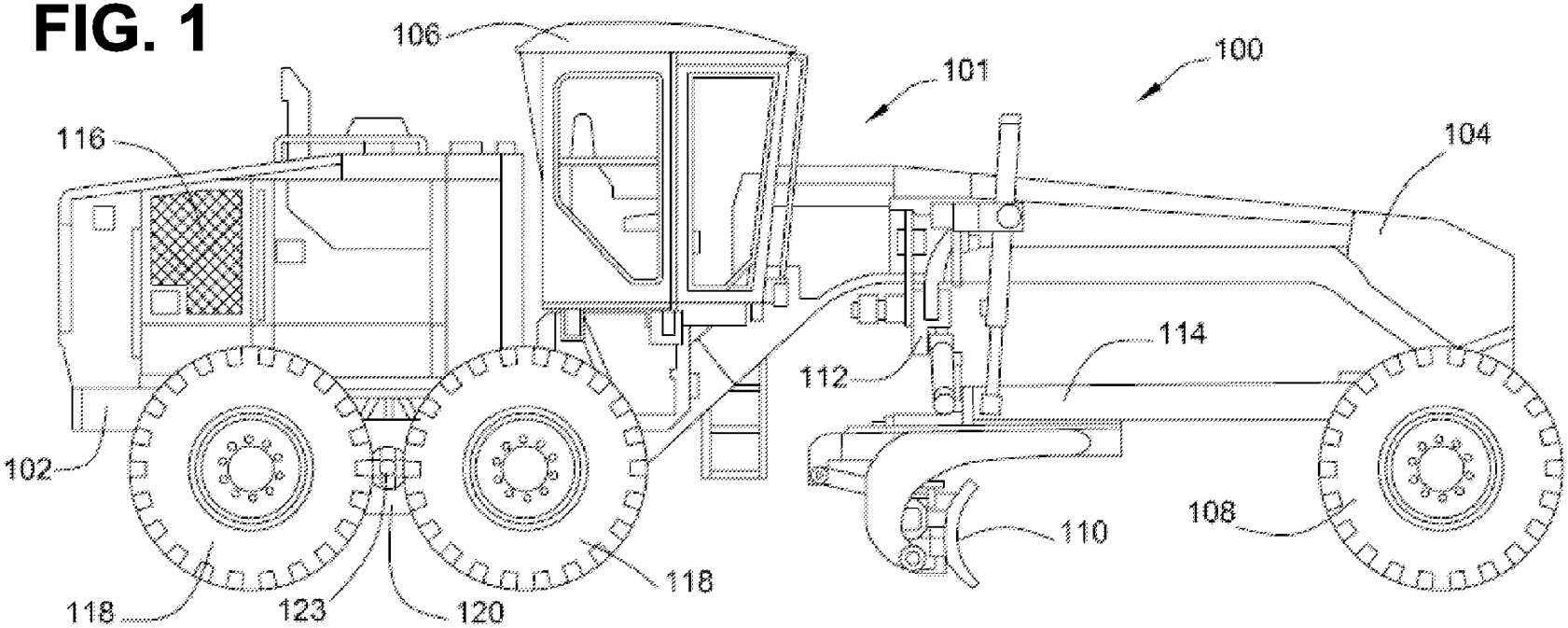
FIG. 1 is an outline side view of a motor grader machine within which embodiments of the described system may be implemented.

With this overview in mind, specific details of the described principles and system will now be discussed. FIG. 1 is an outline side view of a motor grader machine within which the described system may be implemented. The motor grader 101 shown in FIG. 1 generally includes a two-piece frame made up of an engine frame 102 and an implement portion 104. Alternatively, the motor grader 101 may include a single frame piece. The engine frame 102 in the embodiment shown is connected to the implement portion 104 by a pivot (not shown). The implement portion 104 includes an operator cab 106 and two idle wheels 108 (only one visible) that contact the ground. A blade 110 is suspended along a mid-portion of the implement portion 104. The blade 110 can be selectively adjusted to engage the ground at various heights and angles to achieve a desired grade or contour while the motor grader 101 traverses the ground. Adjustment of the position of the blade 110 is accomplished by a system of actuators, generally denoted in FIG. 1 as 112, while support for the loading experienced by the blade 110 during operation is accomplished by a support bar 114, which pivotally connects the implement portion 104 to the blade 110.

The engine frame 102 supports an engine (not visible), which is protected from the elements by an engine cover 116. The engine provides the power necessary to propel the motor grader 101 as well as to operate the various actuators and systems of the motor grader 101. As can be appreciated, other machines may have different configurations and/or various other implements associated therewith. In a hydrostatically operated machine, the engine in the engine frame 102 may be associated with a hydrostatic pump (not shown), which may be part of a propulsion system of the motor grader 101. In the embodiment shown, the motor grader 101 is driven by two sets of drive wheels 118 (only one set visible), with each set including two drive wheels 118 that are arranged in a tandem configuration along a beam 120. Two such beams 120 are pivotally connected on the ends of a shaft or axle 122 at a respective pivot joint or bearing 123, with one beam 120 disposed on either side of the motor grader 101.

The axle 122 is connected to the engine frame 102 of the motor grader 101 via mounting plates and stabilizer bars such that the drive wheels 118 can effectively propel the motor grader 101. In an alternative embodiment, the axle 122 may be omitted and the beams 120 may instead be pivotally connected directly to the engine frame 102. At least one or both of the two drive wheels 118 on the beam 120 may be actively rotated.

Figure 2:
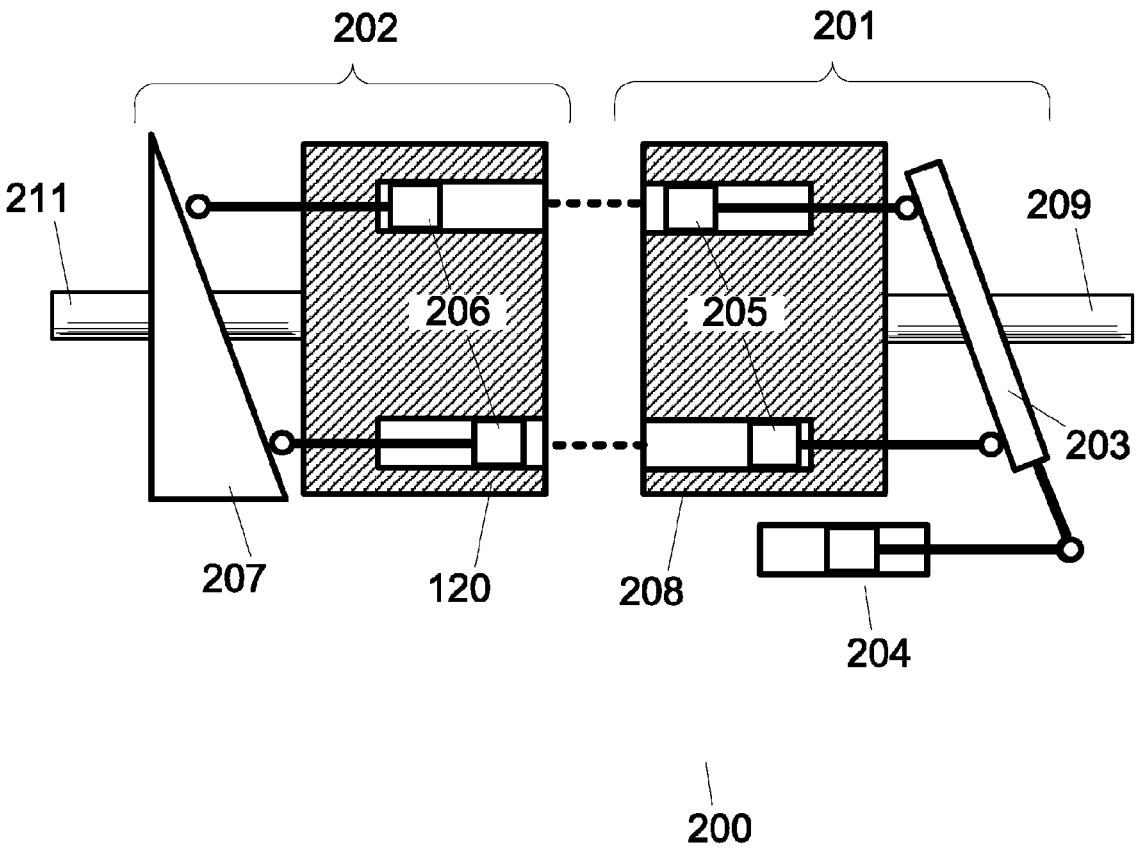
FIG. 2 is a schematic system diagram of a variator for providing a variable output torque based on an applied control pressure differential in accordance with the described principles.
Figure 3:
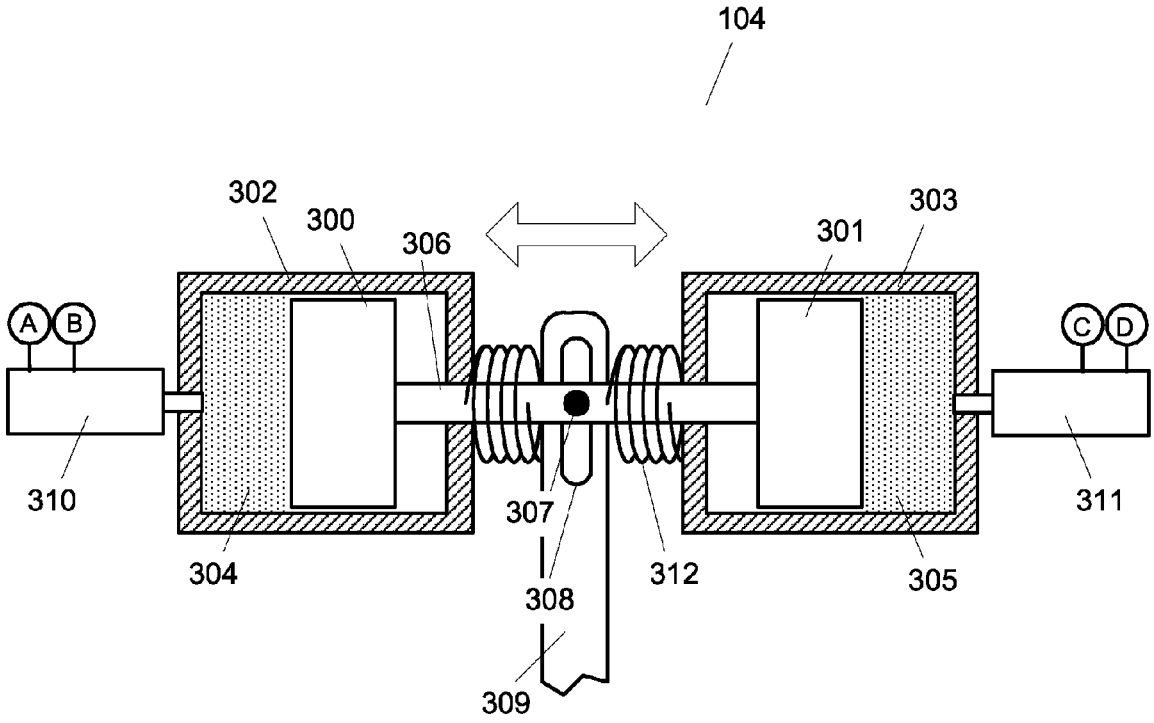
FIG. 3 is a detailed schematic of hydraulic actuator for controlling the position of a variable-angle swash plate within a variator.

Although a motor grader such as motor grader 101 shown in FIG. 1 may be powered by various power and transmission systems, a hydraulic CVT is used in the power train in an embodiment. One implementation of this includes a variator and associated actuator as shown in FIGS. 2 and 3. In particular, FIG. 2 is a schematic system diagram of a variator for providing a variable output torque based on an applied control pressure differential. The variator 200 comprises a pump 201 and a motor 202. The pump 201 comprises a variable angle swash plate 203 set by a swash plate actuator 204. A number of pistons 205 in respective chambers ride on the swash plate 203 via sliding contacts, such that the range of movement of the pistons 205 is set by the angle of the swash plate 203. The chambers for the pistons 205 are formed in a pump carrier 208 that is rotated via the pump input shaft 209.

The motor 202 comprises a similar arrangement including a number of pistons 206 in respective chambers. The pistons 206 of the motor 202 are slidably engaged upon a fixed swash plate 207. The chambers of the pistons 205 of the pump 201 are in fluid communication with the chambers of the pistons 206 of the motor 202 via hydraulic fluid that fills the chambers and intervening conduits (not shown). The chambers for the pistons 206 are formed in a motor carrier 210 that rotates the motor output shaft 211. As the angle of the swash plate 203 is varied, the amount of fluid displaced by the pistons 205 of the pump 201 (and thus the fluid volume received or taken from the chambers of the pistons 206) varies.

Because of these interrelationships, the torque and/or output speed of the motor 202 varies with the angle of swash plate 203. In overview, the swash plate actuator 204, which in this example operates on differential hydraulic pressure, is driven via solenoid valves (not shown in FIG. 2), e.g., one for each of two pressure values. The solenoid valves are controlled electronically by appropriate input signals from a transmission controller or the like. In this way, a controller can control the output speed of the variator 200 via the application of electrical signals to solenoid valves associated with the swash plate actuator 204.

FIG. 3 is a more detailed schematic drawing of the hydraulic actuator 204 for controlling the position of a variable-angle swash plate (not shown in FIG. 3) in a variator 200 such as that shown in FIG. 2. The actuator 204 includes a number of interrelated elements including primarily two opposed pistons 300, 301 (or opposed chambers of a single piston) within respective cylinders 302, 303. The pistons 300, 301 cooperate with the bores of their respective cylinders 302, 303 to form respective pressure chambers 304, 305 for containing pressurized hydraulic fluid.

The pistons 300, 301 are joined by a bar 306 which has a central pivot pin 307 mounted thereon. The central pivot pin 307 interferes within a slot 308 in a swash plate arm 309, such that the lateral position of the bar 306 establishes the position of the swash plate arm 309 and hence the angle of the swash plate itself (not shown). The bar 306 is biased to a central position by opposing springs 312. As the bar 306 is displaced from this central position, there is a restoring force exerted by springs 312 that is proportional to the displacement.

The lateral position of the bar 306 is determined by the positions of the pistons 300, 301 within the cylinders 302, 303. The positions of the pistons 300, 301 are determined by the difference in hydraulic pressure between the pressure chambers 304, 305. Respective pressure valves 310, 311 independently control the pressure within chambers 304, 305. In an example, the pressure valves 310, 311 are solenoid valves that supply hydraulic fluid at a pressure that is set by an applied current within limits set by a supply pressure. Thus, in the illustrated example, each valve 310, 311 has at least a current input (illustrated as inputs A and C) and a fluid input (illustrated as inputs B and D). Typically, solenoid valves can supply fluid at any pressure between zero and the fluid pressure at the fluid input B, D. The pressure response of a solenoid valve such as solenoid valves 310 and 311 to a current input is a function of various components and their tolerances.

Because the distance between the pistons 300, 301 is fixed by the length of the bar 306, it is the pressure differential between chambers 304, 305 rather than the absolute pressure within each chamber 304, 305 that establishes the position of the bar 306. In particular, when the bar 306 is in such a position that the net displacement force differential between the pistons 300, 301 is equal to the net restoring force exerted by springs 312, the system is in equilibrium.

Considering FIG. 3 in conjunction with FIG. 2, it will be appreciated that the torque supplied at output 211 is related to the displacement of the motors, which is in turn influenced by the pressure differential applied by valves 310, 311. In particular, the fluid pressure within the hydraulic circuit between pistons 205 and 206 is related to the angle of swash plate 203, and the angle of swash plate 203 is related to the pressure differential applied by valves 310, 311. Thus, in torque-controlled applications like the present system, it is desirable to correlate combinations of solenoid currents for valves 310 and 311 (or applied pressure differential in actuator 204) with expected associated output torques at output 211.

The present disclosure is not limited to the particular electro hydraulic solenoid controlled pump and motor arrangement described in conjunction with an illustrated embodiment. To the contrary, other pump and/or motor controlled technologies that are mechanical or hydraulic may be used to supply torque to the wheels. For example, the disclosure may utilize other pump and motor constructions without axial pistons and swash plate arrangements. Such systems may not use hydraulic pumps or motors at all so long as an output torque limit may be set in accordance with the principles described herein.

Figure 4:
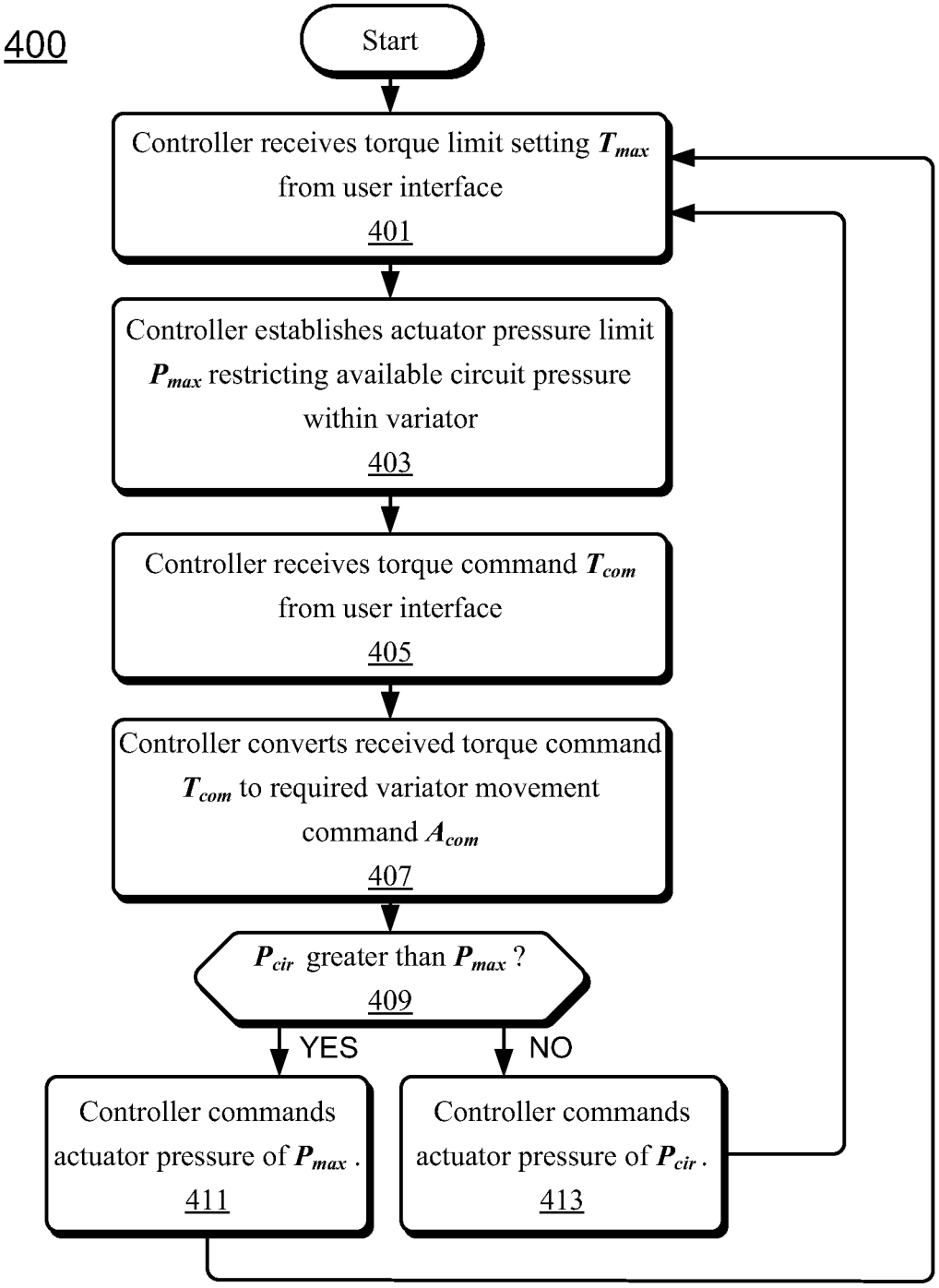
FIG. 4 is a flow chart showing an exemplary process flow for limiting wheel spin during grading in accordance with the described principles.

To better understand the torque control provided by the presently describe principles, the flow chart of FIG. 4 illustrates an exemplary process flow 400 associated with the control inputs and the mechanical components of FIGS. 1-3 to operate the variator 200 to effectively limit wheel spin. In particular, at stage 401 of process 400, the machine controller receives a torque limit setting $T_{max}$ from a torque limiting user interface element. The machine controller may be implemented as a discreet element, or as a part of a transmission controller, engine controller, or more generalized machine controller.

In an embodiment, the torque limiting user interface element is a knob, slider, or other multi-setting or continuously variable setting device. In an aspect of this embodiment, the user preferably sets the torque limiting user interface element to a position corresponding to a value less than a highest value that does not permit wheel slippage on the underlying surface. Thus, for example, on a hard wet surface or a hard surface covered by loose debris such as sand, the maximum torque attainable without slippage may be much lower than the maximum torque usable on another surface type. To identify the appropriate torque limit in any given environment, the user may perform a trial cut, or brake the non-driven wheels, or provide other resistance, while increasing the applied torque until slippage occurs. Such a trial cut may be performed as the operator first uses the equipment at the beginning of a shift, at the beginning of the day, or at any other convenient time.

Once the selected torque limit $T_{max}$, is provided to the controller at stage 401, the controller establishes an appropriate maximum set point with respect to a variable that varies as a function of output torque. In the described example, the controller establishes an actuator pressure limit $P_{max}$ at stage 403 to limit the available circuit pressure within the variator. As will be appreciated, $P_{max}$ is selected such that at an actuator pressure of $P_{max}$, the output torque of the variator, multiplied or reduced as required by any driveline ratio, corresponds to the maximum output torque $T_{max}$.

At stage 405, the controller receives a torque command $T_{com}$ from the user interface, e.g., via an accelerator lever or pedal. Optionally, the torque command $T_{com}$ may be received from an automated source, pursuant to a user speed control command. The received torque command $T_{com}$ is converted to a required motor displacement D, which may correspond to an actuator movement command $A_{com}$ that is necessary to achieve the required motor displacement at stage 407. That is, the actuator movement command $A_{com}$ corresponds to an actuator position that establishes a desired swash plate angle, which in turn achieves a motor displacement D. This conversion may be executed via a mapping, a table, a calculation or other suitable means of deriving an actuator pressure to provide a desired variator output torque.

At stage 409, the process 400 determines whether the motor displacement D results in an excess circuit pressure. In the illustrated embodiment, the process determines whether the motor displacement results in a circuit pressure $P_{cir}$ that exceeds the maximum pressure $P_{max}$. If it is determined that the circuit pressure $P_{cir}$ does exceed the maximum pressure $P_{max}$, then the process flows to stage 411. At this stage, the controller commands an actuator pressure of $P_{max}$, to set the swash plate angle, and thereby the displacement of the motor 202. If it is instead determined that $P_{cir}$ does not exceed $P_{max}$, then the process 400 flows to stage 413, wherein the controller commands an actuator pressure of $P_{cir}$, corresponding to the current motor displacement The process 400 repeats at a rate determined by the controller cycle, receiving new torque commands, and providing an actuator pressure command that is either $P_{com}$ or $P_{max}$, depending upon their relative magnitudes. In this way, the system prevents wheel slippage without the operator being required to grade the surface by employing multiple overly shallow passes.

Figure 5:
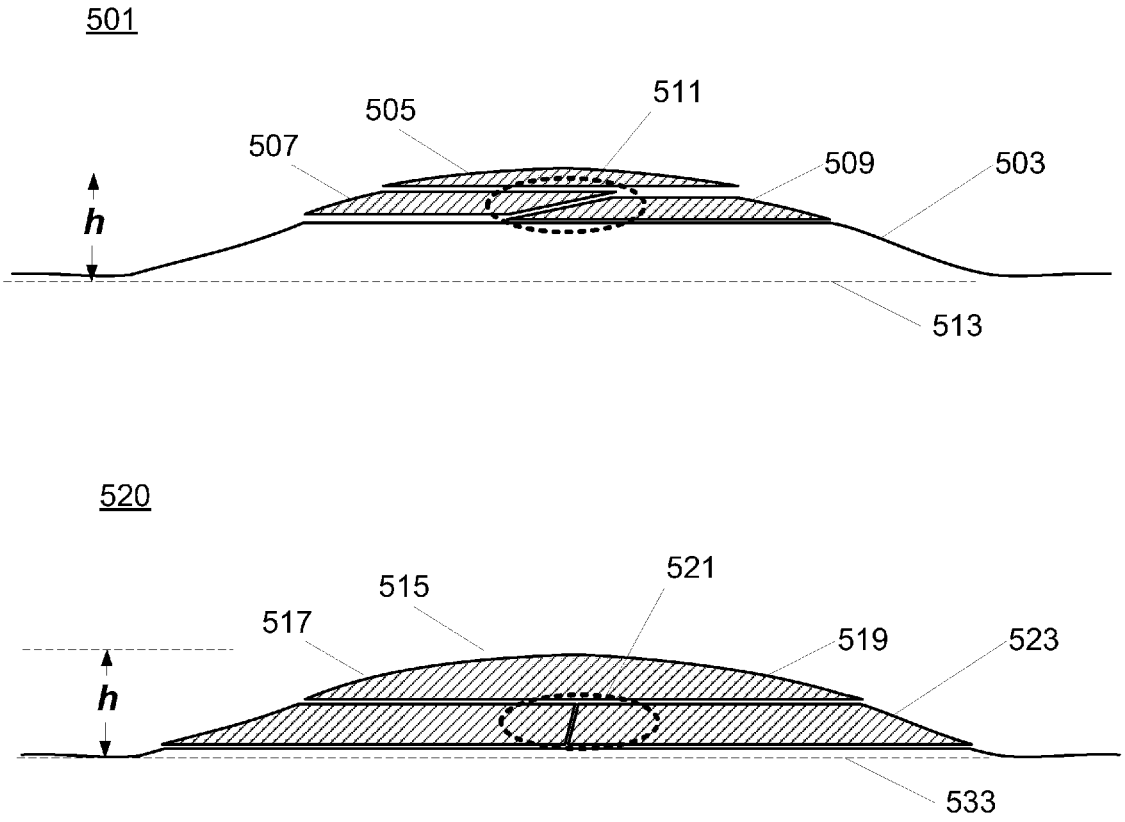
FIG. 5 shows a set of simplified grade schematics, illustrating cut operations with and without employing the torque limiting system described herein.

The operational impact of the described torque limiting control system can be seen in the simplified grade schematics of FIG. 5. In particular, schematic 501 shows a series of cuts used to partially reduce an obstruction 503 of height h, with the goal of eventually reaching a desired grade 513. The cuts shown in schematic 501 assume that the described system of torque control is not employed, and that the operator is forced to use overly shallow cut depths, i.e., cut depths that will almost certainly not result in wheel slippage.

The first cut 505 removes the top portion of the obstruction 503. A second cut 507 removes a portion of a shallow second layer, and a third cut removes the remainder of the shallow second layer. The transition 511 between the second cut 507 and the third cut 509 will generally be a gradual transmission caused by the operator raising the blade at the end of the second cut 507 while continuing to move forward.

The schematic 520 shows another series of cuts used to partially reduce a similar obstruction 523 of the same height h, with the goal of eventually reaching a desired grade 533. In contrast to schematic 501, the cuts shown in schematic 520 assume that the described system of torque control is being employed, and that the operator is using the maximum torque that will not result in wheel slippage.

The first cut 515 removes a large portion of top of the obstruction 523. The second cut 517 removes a portion of a deep second layer, and the third cut removes the remainder of the deep second layer. The transition 521 between the second cut 517 and the third cut 519 is now abrupt rather than gradual, allowing the operator to easily identify the end of the second cut 517, i.e., the location at which to begin the third cut 519. The abrupt nature of the transition 521 is due to the fact that the operator simply drives into the second cut 517 until the torque limit is reached, at which point the machine stops. At this point, the operator raises the blade and/or backs away, and then approaches for the third cut 519.

Figure 6:
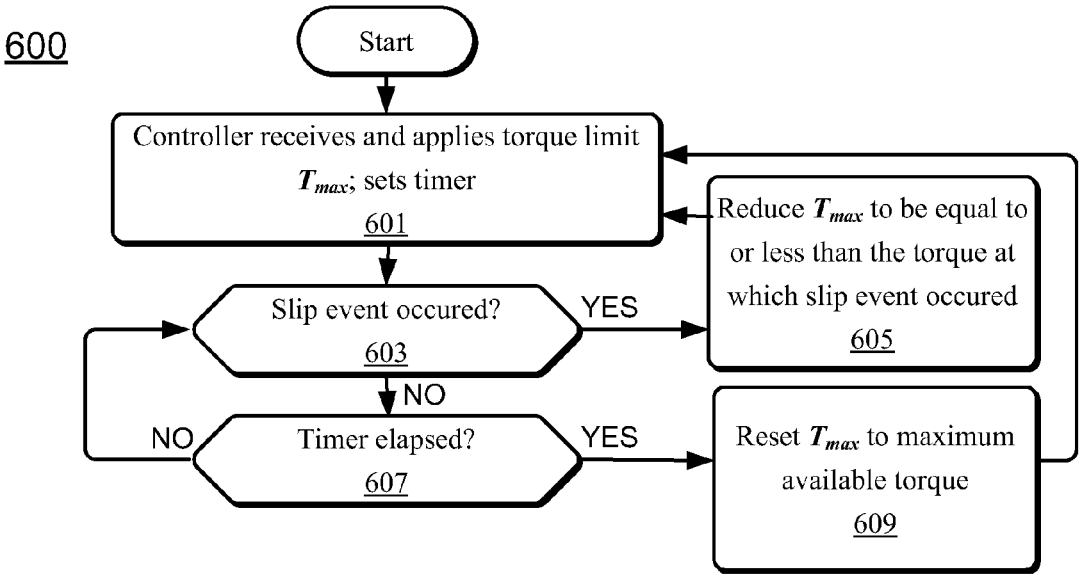
FIG. 6 is a flow chart showing another process flow for limiting wheel spin during grading according to another embodiment of the disclosure.

FIG. 6 shows another embodiment of an exemplary process flow 600 to effectively limit wheel spin based upon a torque limit. In this embodiment, the amount of available traction is determined by an appropriate sensing mechanism, such as a traction control system used with the machine. Specifically, the traction control system includes wheel speed sensors that enable a determination of whether a wheel experiences an overspin condition relative to other wheels of the machine, as will be understood by those skilled in the art. By way of example, the system may determine that an overspin condition exists when a wheel speeds exceeds a maximum percentage relative to other wheels speeds.

At stage 601 of the process 600, the machine controller obtains a torque limit $T_{max}$ value from any of a number of sources, such as a value stored in memory or via a torque limiting user interface as described above. During operation of the machine after this point, torque commands of greater than $T_{max}$ will be reduced to $T_{max}$, while torque commands of less than $T_{max}$ will be applied without modification. The controller may also set a timer, e.g., for one hour, at stage 601. At stage 603, the controller detects whether a slip event has occurred. By way of example, the controller may obtain a signal from a traction control system that determines an overspin condition exists, such as when the wheel speed of one wheel relative to another wheel exceeds a threshold. If the controller determines at stage 603 that a slip event has occurred, then the process proceeds to a stage 605 and sets a new torque limit $T_{max}$, which may correspond to a maximum torque that is equal to, or somewhat less than, the torque at which the slip event occurred. From stage 605, the process returns to stage 601.

If the controller determines at stage 603 that a slip event has not occurred, then the process proceeds to stage 607, wherein the controller determines whether the timer has elapsed. The timer may allow the controller to periodically alter the maximum torque limit if warranted by current conditions even in the absence of wheel slip. If at stage 607 the controller determines that the timer has elapsed, the process proceeds to stage 609 and resets the torque limit setting $T_{max}$ to a maximum available torque or other value higher than the present $T_{max}$. The new torque limit $T_{max}$ being greater than the current torque limit setting $T_{max}$ enables the machine to operate at greater torque, such as when conditions permit such operation. This permits system testing and updates to occur on a regular basis. On the other hand, if at stage 607 the controller determines that the timer has not elapsed, the process returns to stage 603. As noted above, the torque control actions executed by the machine are executed by a controller in one implementation. The controller may be of any suitable construction; however, in one example it comprises a digital processor system including a microprocessor circuit having data inputs and control outputs, operating in accordance with computer-readable instructions stored on a computer-readable medium. Typically, the processor will have associated therewith long-term (non-volatile) memory for storing the program instructions, as well as short-term (volatile) memory for storing operands and results during (or resulting from) processing.

INDUSTRIAL APPLICABILITY

The described principles are applicable to machines that are used for grading applications and which include a ground-engaging mechanism, e.g., wheels, tracks, etc. A primary example of such a machine is a motor grader. Within such applications, the described principles provide a user-settable torque limiting function to avoid wheel spin and attendant surface marring while grading a surface. In this way, the operator of the motor grader or other grading machine is able to make a fewer number of more aggressive cuts to complete a surfacing operation with greater efficiency without sacrificing surface quality. It will be appreciated that the described principles also apply to machines used for operations other than grading where wheel slippage is undesirable. Moreover, other ground engaging mechanisms such as tracks are also usable within the described principles.

Various other modifications may also be employed. For example, the maximum torque threshold may determined in any number of ways, such as through user setting or machine determination based upon historical data concerning the available traction of the ground engaging elements. The amount of available traction may be determined either manually or automatically, such as through any of, or a combination of, radar, GPS, wheel speed sensors and direct observation. Also, the torque limiting functionality of this disclosure may be used in conjunction with a suitable warning system. By way of example, the system may provide a warning signal or indication to the user when the maximum torque threshold has been reached. In this way, the user may take appropriate action if desired. Alternatively or in addition, the torque limiting functionality of this disclosure may be used in conjunction with a GPS-guided system to more precisely determine depth of cut or other sequences of operation. For example, such an integrated system may be used to determine a real-time cutting sequence or the like for a particular application.

Thus, although it will be appreciated that the foregoing description provides useful examples of the disclosed system and technique, it should be appreciated that other implementations of the disclosed principles will differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein.

We claim:

1. A system for preventing wheel slippage during grading of a surface by a grader, the system comprising:

a grader having a plurality of ground engaging elements and a grading blade extending from the grader toward a surface underlying the grader, the grader including a user interface portion;

a primary power source and a transmission linking the primary power source to one or more of the plurality of ground engaging elements;

a user-settable torque limiter and an accelerator control on the user interface portion of the grader, wherein the user-settable torque limiter is configured to be adjustable by an operator of the grader to indicate a desired maximum torque to be applied by one or more of the plurality of ground engaging elements; and a controller for receiving a signal from the user-settable torque limiter and responsively setting a maximum torque available from the transmission to the one or more of the plurality of ground engaging elements regardless of commands received from the accelerator control.

2. The system for preventing wheel slippage according to claim 1, wherein the maximum torque available from the transmission is less than a slip torque required to cause slippage of the one or more of the plurality of ground engaging elements against the surface underlying the grader.

3. The system for preventing wheel slippage according to claim 1, wherein the primary power source comprises an engine and the transmission linking the primary power source to one or more of the plurality of ground engaging elements comprises a CVT.

4. The system for preventing wheel slippage according to claim 3, wherein the CVT comprises a hydraulic motor having a variable displacement to control output torque.

5. The system for preventing wheel slippage according to claim 1, wherein the controller is a digital processor system including a microprocessor circuit operating in accordance with computer-readable instructions stored on a computer-readable medium.

6. A method of permitting an operator to apply a maximum amount of torque without wheel slip to a motor grader having one or more driven wheels and a blade for grading an underlying ground surface, the method comprising:

determining a slip torque required to cause slippage of one or more driven wheels against the underlying ground surface;

receiving a user-set maximum desired torque value relative to the determined slip torque;

receiving a torque command corresponding to a currently desired torque value, wherein the currently desired torque value is near or exceeds the maximum desired torque value; and providing a torque to the one or more driven wheels, wherein the provided torque is the lesser of the user-set maximum desired torque value and the currently desired torque value.

7. The method of permitting an operator to apply a maximum amount of torque without wheel slip according to claim 6, wherein the user-set maximum desired torque value is received from a variable torque setting user interface element in a cab of the motor grader.

8. The method of permitting an operator to apply a maximum amount of torque without wheel slip according to claim 6, wherein the torque command corresponding to a currently desired torque value is received from a user-actuated accelerator element in a cab of the motor grader.

9. The method of permitting an operator to apply a maximum amount of torque without wheel slip according to claim 6, wherein the torque command corresponding to a currently desired torque value is generated by a controller based on a user speed command.

10. The method of permitting an operator to apply a maximum amount of torque without wheel slip according to claim 6, wherein the user-set maximum desired torque value is less than a slip torque required to cause slippage of the one or more driven wheels against the underlying ground surface.

11. The method of permitting an operator to apply a maximum amount of torque without wheel slip according to claim 6, wherein the motor grader includes a primary power source and a transmission linking the primary power source to the one or more driven wheels.

12. The method of permitting an operator to apply a maximum amount of torque without wheel slip according to claim 11, wherein the transmission linking the primary power source to the one or more driven wheels comprises a CVT.

13. The method of permitting an operator to apply a maximum amount of torque without wheel slip according to claim 12, wherein the CVT comprises a hydraulic variator having a circuit pressure corresponding to output torque.

14. A system for preventing wheel slippage during grading of a surface by a grader, the system comprising:

a grader having a plurality of ground engaging elements and a grading blade extending from the grader toward a surface underlying the grader;

a primary power source including an engine and a CVT transmission linking the primary power source to one or more of the plurality of ground engaging elements;

a user interface including an accelerator control;

a traction control system disposed to determine a relative speed of at least one of the ground engaging elements with respect to another of the ground engaging elements and to provide a signal indicative of a slip event when the relative speed exceeds a threshold; and a controller for receiving commands from the accelerator control and the signal indicative of a slip event from the traction control system and responsively setting a maximum pressure applied to the CVT transmission to thereby provide a maximum torque to the one or more of the plurality of ground engaging elements based upon the signal indicative of a slip event.

15. The system for preventing wheel slippage according to claim 14, wherein the maximum torque available from the transmission is less than a slip torque required to cause slippage of the one or more of the plurality of ground engaging elements against the surface underlying the grader.

16. The system for preventing wheel slippage according to claim 15, wherein the controller is configured to receive a torque command and to responsively provide a hydraulic pressure signal to the hydraulic actuator, wherein the hydraulic pressure signal is associated with the received torque command if the received torque command indicates a torque that is less than or equal to the desired maximum torque.

17. The system for preventing wheel slippage according to claim 15, wherein the controller is configured to receive a torque command and to responsively provide a hydraulic pressure signal to the hydraulic actuator, wherein the hydraulic pressure signal is the maximum hydraulic pressure to be applied to the hydraulic actuator if the received torque command indicates a torque that exceeds the desired maximum torque.

18. A system for preventing wheel slippage during grading of a surface by a grader, the system comprising:

a grader having a plurality of ground engaging elements and a grading blade extending from the grader toward a surface underlying the grader, the grader including a user interface portion;

a primary power source including an engine and a CVT transmission including a hydraulic motor having a variable displacement to control output torque and a hydraulic actuator controlled by applied hydraulic pressure, the CVT transmission linking the primary power source to one or more of the plurality of ground engaging elements;

a user-settable torque limiter on the user interface portion of the grader, wherein the user-settable torque limiter is usable by an operator of the grader to indicate a desired maximum torque to be applied by one or more of the plurality of ground engaging elements; and a controller for receiving a signal from the user-settable torque limiter and responsively setting a maximum hydraulic pressure to be applied to the hydraulic actuator to thereby limit the torque available from the transmission to the one or more of the plurality of ground engaging elements.

19. A method of limiting wheel slip in a motor grader having one or more driven wheels, a blade for grading an underlying ground surface, a primary power source and a CVT transmission with a hydraulic variator having a circuit pressure corresponding to output torque controlled by a hydraulic actuator, the CVT transmission linking the primary power source to the one or more driven wheels, the method comprising:

receiving a user-set maximum desired torque value;

establishing a maximum hydraulic pressure to be applied to the hydraulic actuator based on the user-set maximum desired torque value;

receiving a torque command corresponding to a currently desired torque value; and providing a torque to the one or more driven wheels by applying a hydraulic pressure to the hydraulic actuator, wherein the provided torque is the lesser of the user-set maximum desired torque value and the currently desired torque value.

* * * * *